US010021976B1

(12) United States Patent
Allen

(10) Patent No.: US 10,021,976 B1
(45) Date of Patent: Jul. 17, 2018

(54) FURNITURE SYSTEM

(71) Applicant: Scott Allen, Highlands Ranch, CO (US)

(72) Inventor: Scott Allen, Highlands Ranch, CO (US)

( * ) Notice: Subject to any disclaimer, the term of this patent is extended or adjusted under 35 U.S.C. 154(b) by 0 days.

(21) Appl. No.: 15/801,233

(22) Filed: Nov. 1, 2017

Related U.S. Application Data

(60) Provisional application No. 62/415,877, filed on Nov. 1, 2016.

(51) Int. Cl.
*A47B 1/00* (2006.01)
*A47B 81/06* (2006.01)
*A47B 97/00* (2006.01)

(52) U.S. Cl.
CPC ..... *A47B 81/06* (2013.01); *A47B 2097/003* (2013.01); *A47B 2200/008* (2013.01); *A47B 2200/04* (2013.01)

(58) Field of Classification Search
CPC ..... A47B 81/06; A47B 2097/003; A47B 2200/008; A47B 2200/0081; A47B 2200/04
See application file for complete search history.

(56) References Cited

U.S. PATENT DOCUMENTS 6,017,218 A * 1/2000 Bright ..... G06K 9/00 434/155
6,209,974 B1 * 4/2001 Goto ..... A47B 81/06 312/223.6
7,098,406 B1 * 8/2006 Hammonds ..... B65H 75/06 174/135
8,276,523 B2 * 10/2012 Miller ..... A47B 21/00 108/50.02
9,176,531 B1 * 11/2015 Hayden ..... G06F 1/1632
9,635,932 B2 * 5/2017 Kelley ..... A47B 21/06
2005/0176290 A1 * 8/2005 Lichtscheidl ..... H01R 25/003 439/501
2006/0057608 A1 * 3/2006 Kaufman ..... C12Q 1/6855 435/6.12
2006/0096507 A1 * 5/2006 Smith ..... A47B 81/06 108/50.02
2006/0141855 A1 * 6/2006 Bloom ..... H01R 13/447 439/501
2006/0179458 A1 * 8/2006 Schmieder ..... A47B 81/06 725/78
2008/0029461 A1 * 2/2008 Gray ..... B01D 61/022 210/741
2008/0169734 A1 * 7/2008 Bartels ..... A47B 81/06 312/7.2

(Continued)

*Primary Examiner* — Daniel J Rohrhoff
(74) *Attorney, Agent, or Firm* — Eldredge Law Firm, LLC; Richard Eldredge

(57) ABSTRACT

A furniture system includes a furniture component, having a base; a top; and a back; one or more connection ports secured within the back, the one or more connection ports having a plug in; and a receiving case, secured on the back; a central connection box, secured on a back surface of the back; one or more cables extending from each of the one or more connection ports and to the central connection box; an electronic cable extending from the central connection box and configured to engage with a television; and an outlet cable extending from the central connection box and to plug into an outlet; the one or more connection ports receive one or more cords associated with electronic accessories.

6 Claims, 4 Drawing Sheets

(56) References Cited

U.S. PATENT DOCUMENTS

| | | | | |
|---|---|---|---|---|
| 2008/0224582 | A1* | 9/2008 | Boland | A47B 21/06 312/330.1 |
| 2010/0006715 | A1* | 1/2010 | Wills | A47B 81/06 248/121 |
| 2012/0097418 | A1* | 4/2012 | Ruotsala | H02G 11/00 174/60 |
| 2013/0061783 | A1* | 3/2013 | Bennie | A47B 21/06 108/25 |
| 2014/0035363 | A1* | 2/2014 | Fleisig | H01R 13/72 307/11 |
| 2016/0120304 | A1* | 5/2016 | McGowan | A47B 21/06 108/48 |
| 2017/0018952 | A1* | 1/2017 | Finckh | G06F 1/1601 |
| 2017/0143113 | A1* | 5/2017 | Park | A47B 21/06 |
| 2017/0196357 | A1* | 7/2017 | Head | A47B 88/944 |
| 2018/0048904 | A1* | 2/2018 | Pandit | H04N 19/61 |

* cited by examiner

FURNITURE SYSTEM

BACKGROUND

1. Field of the Invention

The present invention relates generally to furniture systems, and more specifically, to a furniture system for consolidating electrical cords and reducing cord visibility.

2. Description of Related Art

Furniture systems are well known in the art and are effective means to hold electronics, such as televisions. For example, FIG. 1 depicts a conventional furniture system 101 having a television 103 resting on a furniture component 105, and one or more electronic accessories 107*a-b* in communication with one or more outlets 109-*b* and with the television 103 by a plurality of cables 111*a-e*. During use, the cables 111*a-e* are manipulated in a manner necessary to reach both the television 103 and outlets 109.

One of the problems commonly associated with system 101 is unappealing appearance. For example, a user typically has several electronic accessories 107*a-b*, such as gaming consoles and/or video players, which require the user to manipulate many cables 111*a-e*, causing the unsightly appearance of cables 111*a-e*.

In addition, system 101 typically requires multiple outlets.

Accordingly, although great strides have been made in the area of furniture systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
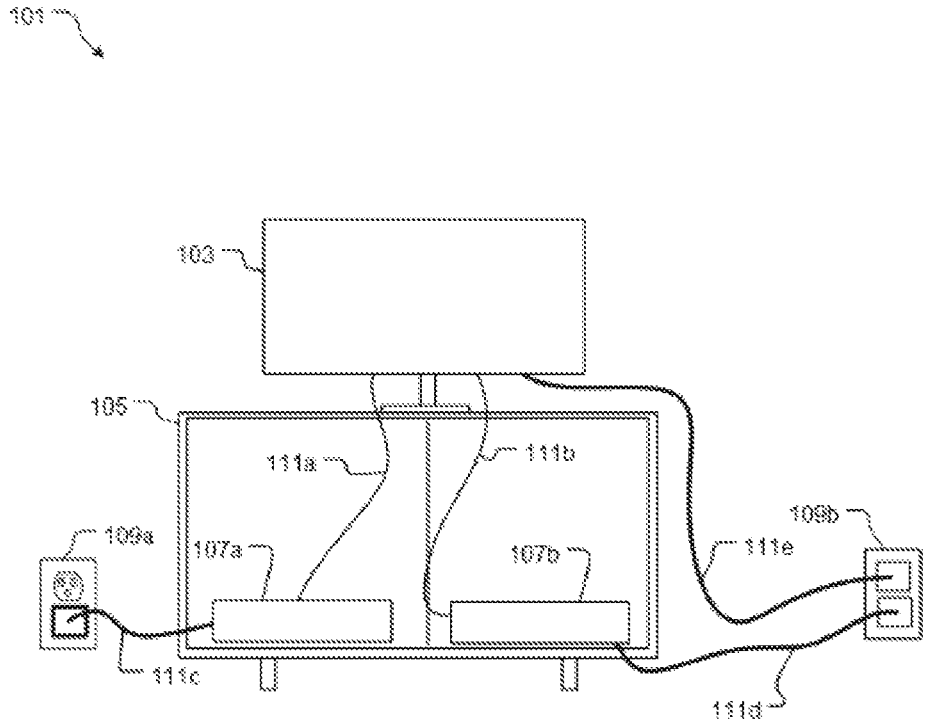
FIG. 1 (Prior Art)
FIG. 1 is a front view of a common furniture system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional furniture systems. Specifically, the present invention provides a means to conceal cords and cables. In addition, the present invention reduces the number of outlets required for a conventional television system. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
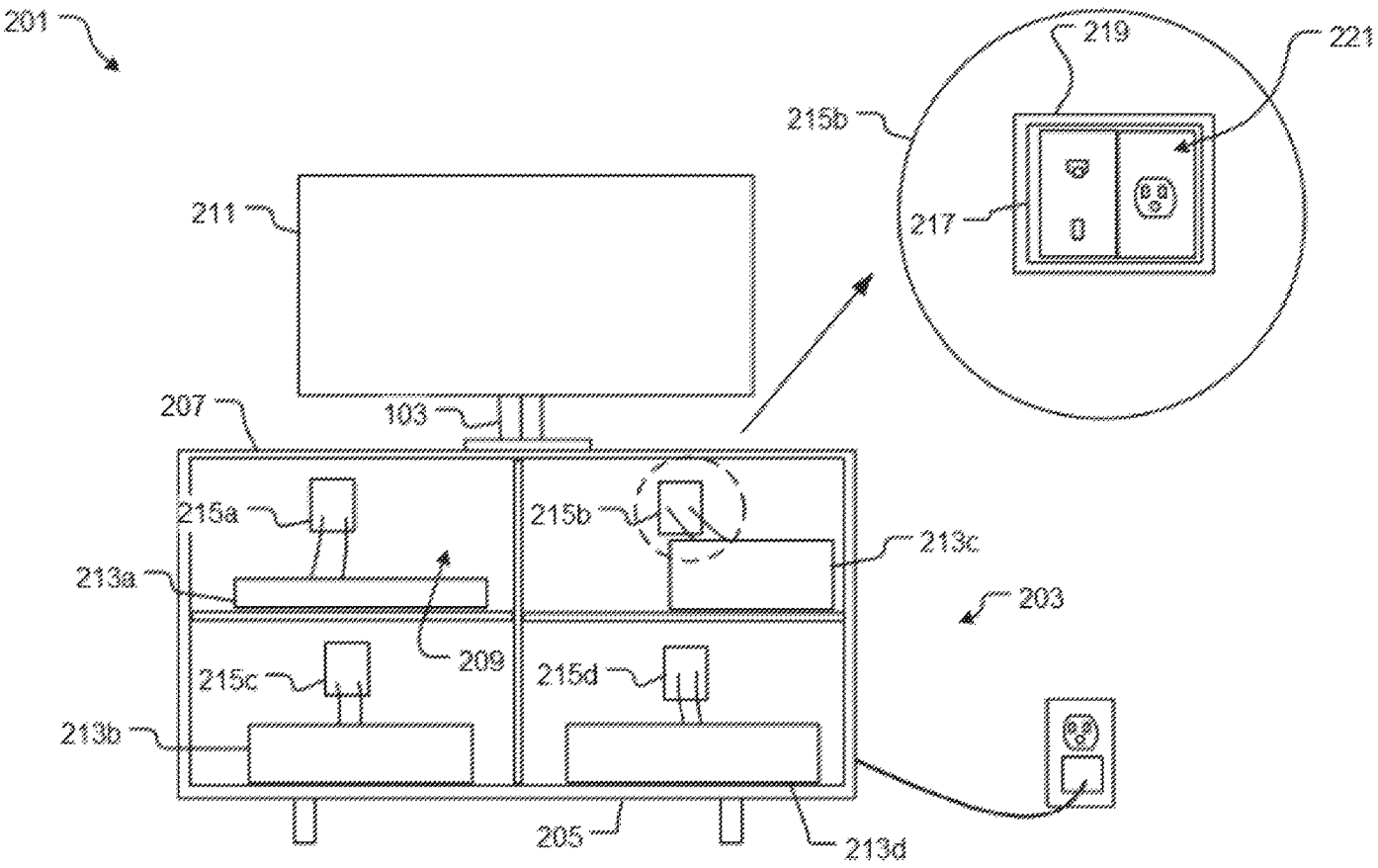
FIG. 2 is a front view of a furniture system in accordance with a preferred embodiment of the present application.

Referring now to the drawings wherein like reference characters identify corresponding or similar elements throughout the several views, FIG. 2 depicts a front view of a furniture system in accordance with a preferred embodiment of the present application. It will be appreciated that system 201 overcomes one or more of the above-listed problems commonly associated with conventional furniture systems.

In the contemplated embodiment, system 201 includes a furniture component 203 having a base 205, a top 207, and a back 209, the furniture component 203 holding an electronic device 211, such as a television, and one or more electronic accessories 213*a-d*, such as gaming consoles, video players, and/or cable boxes. In the preferred embodiment, the furniture component 203 further comprises one or more connection ports 215, secured within the back 209, the connection ports 215 having a plug in 217 and a receiving case 219. In one embodiment, the connection port 215 includes an adaptor 221 having a combined female/male plug, and wherein the adaptor 221 allows for one electrical plug and two other components or two electrical plugs. During use, the electronic accessories 213 plug directly into the connection ports 215*a-d*.

Figure 3:
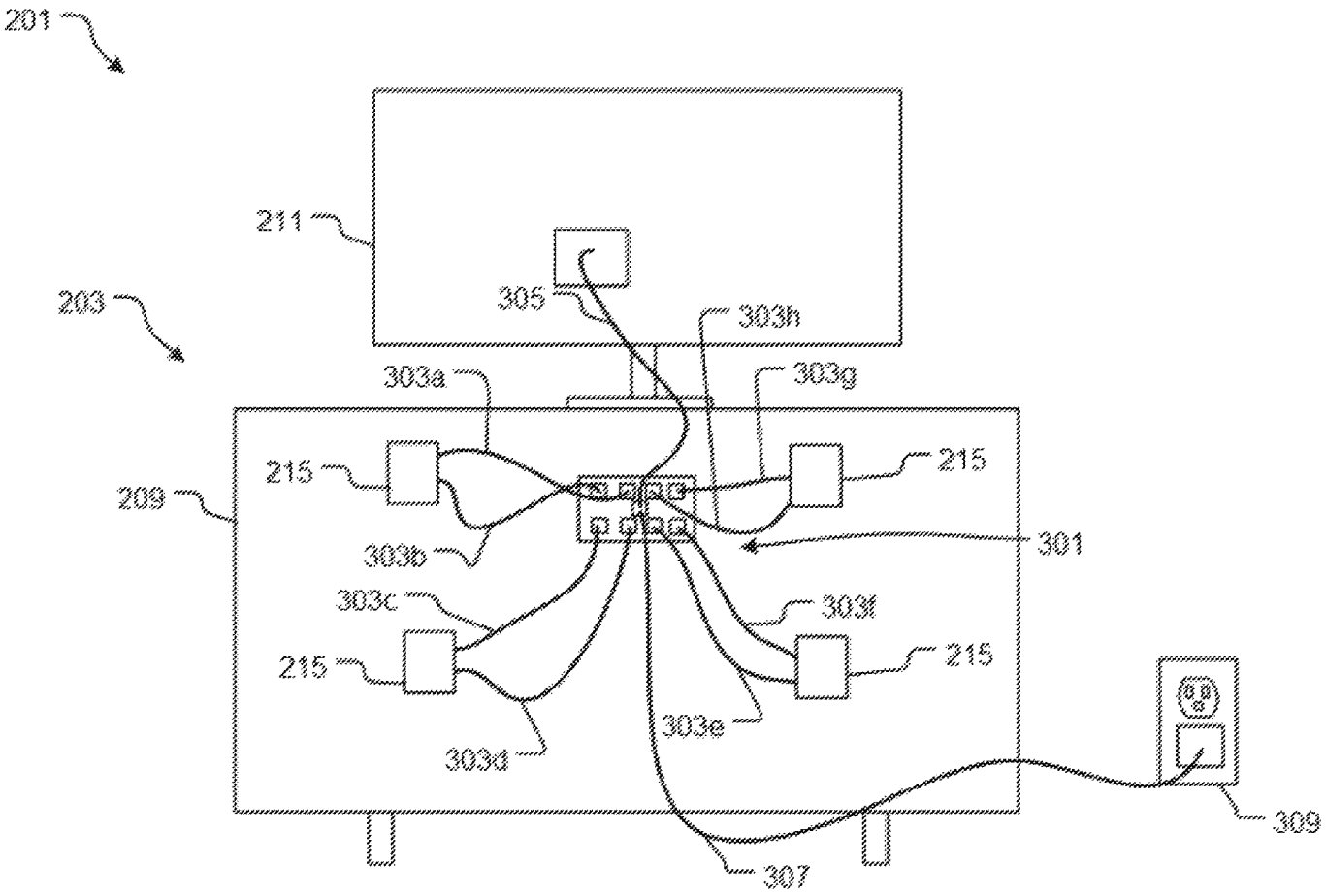
FIG. 3 is a back view of the furniture system from FIG. 2.

In FIG. 3, a back view of system 201 is shown. In the preferred embodiment, the furniture component 203 houses a central connection box 301, and a plurality of cables 303*a-h* are configured to connect the electronic accessories 213, plugged into the connection ports 215, to the central connection box 301. In addition, the central connection box 301 houses an electronic cable 305 configured to travel to the electronic device 211, such as a television, and an outlet cable 307 configured to plug into an outlet 309.

In the contemplated embodiment, the central connection box 301 is configured to provide inlets for cables associated with connecting electronic accessories to televisions, including HDMI, LAN, USB, and/or coaxial It should be appreciated that one of the unique features believed characteristic of the present application is the configuration of connection ports 215, the central connection box 301, and the cables 303, 305, 307 allowing for system 201 to plug into an outlet with one cable 307 and connect to an electronic device 211, such as a television, with one cable 305. It should be appreciated that this configuration improves the appearance of system 201 by concealing cables.

Figure 4:
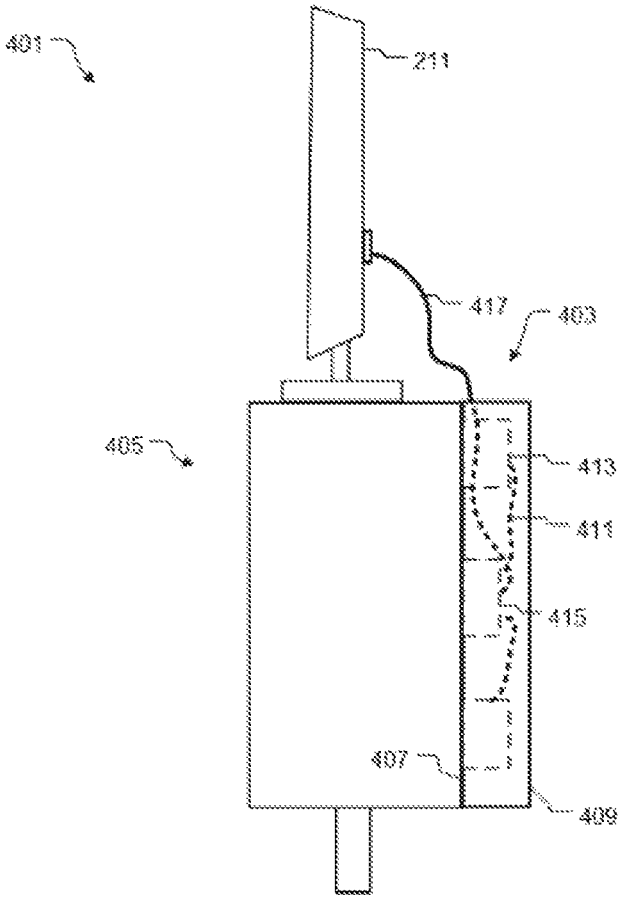
FIG. 4 is a side view of an alternative embodiment of the furniture system from FIG. 2.

In FIG. 4, a side view of an alternative embodiment of a furniture system 401 is shown. In the alternative embodiment, a back 403 of the furniture component 405 includes a first wall 407 and a second wall 409, wherein the plurality of cables 411, the connection ports 413, and a central connection box 415 are concealed between the first 401 and second 403 walls. In this embodiment, the only cables showing would include the cable 417 connecting to television 211, and a single cable to reach to an electrical outlet.

It is contemplated, and should be appreciated, that the furniture component 203 can include shelves, doors, drawers, and/or legs. In addition, it is contemplated that the furniture component 203 can vary in size and material as aesthetical, functional, or manufacturing considerations require.

It is further contemplated, and should be appreciated that the connection ports 213 can provide inlets for a variety of cables, including HDMI, LAN, coaxial, and/or electrical.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A furniture system, comprising:

a furniture component, having:

a base;

a top; and a back;

one or more connection ports secured within the back, the connection ports having:

a plug in; and a receiving case, secured on the back;

a central connection box, secured on a back surface of the back;

one or more cables extending from each of the one or more connection ports and to the central connection box;

an electronic cable extending from the central connection box and configured to engage with a television; and an outlet cable extending from the central connection box and configured to plug into an outlet;

wherein the one or more connection ports receive one or more cords associated with electronic accessories.

2. The system of claim 1, wherein the base comprises:

one or more legs.

3. The system of claim 1, wherein the top is a flat surface configured to hold the television.

4. The system of claim 1, further comprising:

a plurality of shelves; and wherein the shelves are configured to hold electronic components.

5. The system of claim 1, wherein the back further comprises:

a first wall;

a second wall; and wherein the one or more cables, the one or more connection ports, and the central connection box are hidden from view between the first and second walls.

6. The system of claim 1, wherein the plug in of the connection port further comprises:

an adaptor, having:

a combined female/male plug;

wherein the adaptor is configured to snap into the receiving case; and wherein the adaptor allows for one electrical plug and two other component ports.

* * * * *